US010286987B2

(12) United States Patent
Duff

(10) Patent No.: US 10,286,987 B2
(45) Date of Patent: May 14, 2019

(54) LIFE JACKET WITH VISUAL AWARENESS SAFETY ACCESSORY

(71) Applicant: ZUP LLC, Williamsburg, VA (US)

(72) Inventor: Glen Wade Duff, Virginia Beach, VA (US)

(73) Assignee: ZUP LLC, Williamsburg, VA (US)

( * ) Notice: Subject to any disclaimer, the term of this patent is extended or adjusted under 35 U.S.C. 154(b) by 0 days.

(21) Appl. No.: 15/897,737

(22) Filed: Feb. 15, 2018

(65) Prior Publication Data

US 2018/0237115 A1 Aug. 23, 2018

Related U.S. Application Data

(60) Provisional application No. 62/461,204, filed on Feb. 20, 2017.

(51) Int. Cl.

| | |
|---|---|
| ***B63C 9/20*** | (2006.01) |
| ***B63C 9/115*** | (2006.01) |
| ***B63C 9/125*** | (2006.01) |

(52) U.S. Cl.

CPC ..... *B63C 9/20* (2013.01); *B63C 9/115* (2013.01); *B63C 9/1255* (2013.01)

(58) Field of Classification Search

CPC .. B63C 9/00; B63C 9/08; B63C 9/115; B63C 9/125; B63C 9/1255; B63C 9/20

USPC ..... 441/89

See application file for complete search history.

(56) References Cited

U.S. PATENT DOCUMENTS 5,344,351 A * 9/1994 Danielson ..... B63C 9/20 441/89
5,671,480 A * 9/1997 Krout ..... B63C 9/20 441/89
5,893,786 A * 4/1999 Stevens ..... B63C 9/20 441/89
6,749,473 B1 * 6/2004 Lower ..... B63C 9/20 441/89
2008/0045100 A1 * 2/2008 Dungan ..... B63C 9/20 441/89
2011/0092117 A1 * 4/2011 Delgado ..... B63C 9/20 441/89
2011/0097952 A1 * 4/2011 Pirie ..... B63C 9/20 441/89

OTHER PUBLICATIONS https://www.coleman.com/infant-hydroprene/2000019828.html?cgid=stearns-puddlejumper#start=2.
https://www.coleman.com/puddle-jumper-bahamas-series-life-jacket-gator/2000013764.html#q=gator&lang=default&start=2.
https://www.aliexpress.com/item/New-kids-life-jacket-vest-Superman-batman-spiderman-swimming-boys-girls-fishing-superhero-swimming-circle-pool/32740558931.html.

* cited by examiner

*Primary Examiner* — Lars A Olson

(74) *Attorney, Agent, or Firm* — Berenato & White, LLC

(57) ABSTRACT

A Visual Awareness Safety Accessory (VASA) is disclosed for use by a person engaged in watersport/water-based activity. The device may be worn by itself or in combination with a personal flotation device (PFD). The VASA includes a user worn deployable highly visible flag element which is lifted via an attached float when a wearer enters the water. The float raises the flag element well above a user's head whereupon the user can be more easily seen by others using the same waterway. The higher visibility more easily enables location identification of the wearer for rescue, retrieval, and/or collision avoidance.

14 Claims, 21 Drawing Sheets

110

100

108
106
104
102

112

LIFE JACKET WITH VISUAL AWARENESS SAFETY ACCESSORY

This application claims the benefit of prior filed Provisional Application Ser. No. 62/461,204, filed Feb. 20, 2017, and incorporates the contents thereof via this reference thereto.

FIELD OF THE INVENTION

The invention generally relates to the field of life jackets worn as safety enhancing devices during participation in water based activities. The invention specifically relates to an accessory, worn by itself or in combination with a life jacket, for enhancing the visibility of a wearer once the wearer is immersed in water.

BACKGROUND

Currently there are a number of prior art life jackets or personal flotation devices (PFD). Most of these known devices only create a way to help the person in the water stay afloat. But, floating is only part of the problem of safety in the water for the wearer of a life jacket. Other problems exist that necessitate being aware of the exact location of the person floating in the water. The prior safety vests generally ignore the need for higher visibility in many circumstances, for example: water sports activities, swimming, working or playing around water. Known vests are unable to meet the needs of the industry, because they do not help create enough visual awareness of the person in the water, to aid boaters or others to see the actual position of the person in the water. Current PFD devices do not give the wearer additional visibility, even if brightly colored, because 90% of the PFD is beneath the waterline when the person is floating. Also, boaters are traveling at relatively fast speeds and will need time to react to safely avoid conflict with any person in the water once they spot them. They need as much distance as possible to avoid conflict or to be of assistance to locate and help the person get to safety.

Some PFDs do seek to help the person in the water be visible, by waving a flag, usually on the watersports tow boat, so other boaters in the area can be more cautious knowing that someone has fallen into the water. However, this solution fails to meet industry needs. This is because by just being aware that some people are in the water somewhere is not nearly as helpful as being able to see or find them instantaneously. Often boaters will tow more than one person on tubes or other towable, creating a very dangerous situation. Having several people in multiple locations back at the spot where they fell off is very dangerous. On heavy use weekends at many lakes, for example, there will be a lot of traffic and turning around quickly to retrieve your rider can be a problem, as well as the problem of other boater's being able to spot the people in the water quick enough to avoid a conflict with them.

SUMMARY OF THE INVENTION

The invention is an accessory that attaches to existing Coast Guard, UL and CE approved life jackets or personal flotation devices (PFD). The accessory aids in the visibility and buoyancy of the rider/wearer once immersed who needs to be seen, to be rescued or to avoid a collision with a water vehicle (boat or personal watercraft). It can also be a stand-alone device, that is worn with straps. It can be a combination device that automatically or user inflates to perform both a flotation function and a visual awareness function. The device can be used to assist boat drivers and those on the shore who need to increase the possibility of seeing a person floating in the water, from a longer distance or in difficult visual situations, like fog, darkness, rain, choppy swells, etc. The goal is to prevent injury to the rider/wearer who is floating in the water; whether that person in the water needs to be seen to be retrieved or rescued, or whether to prevent accidental impact of a floating person with boaters unaware of the person floating in the water. It also helps the rescue by being able to see the floating person in the water in time to prevent accidental impacts.

The present invention is made up of the following components: A. A brightly colored cape or flag like device. B. A float connected under the cape (between the cape and PFD) that lifts the cape vertically up and out of the water when the rider/wearer wearing the device is floating in the water.

These components are connected as follows: A. The cape is connected and hinged to the back/top side of a PFD, either permanently (i.e., stitched or glued) or semi-permanently (i.e., snapped or Velcro). B. The lifting float under the cape is connected (likewise: permanently or semi-permanently) and hinged to the cape via a secure and strong hinge so as to allow the upward movement of the float, when submerged in the water, to lift the cape vertically and significantly above the floating person's head, to create a dramatically better and easier flag to see the fallen rider floating in the water for their immediate safety. C. The bottom of the float is held securely to the back bottom of the PFD with waterproof fabric straps or open mesh material. It allows water to flow freely through and around the connecting device, so it does not restrict water flow when becoming submerged in water as the rider/wearer jumps or falls into the water from all angles and at all speeds. The present invention essentially has a great range of motion to allow the cape to lift up to a full 170 to 180 degrees from a fully down position when out of the water, to an approximately vertical straight up position, when attached to the back of a PFD and when the rider/wearer is floating in the water.

In use, a person wears a properly fitted life jacket or PFD (Personal Flotation Device) with the attached invention cape and float device. As such, when that person rides a watersports device they are more visible to others on the water as cape flows up partially behind the rider like a super hero cape. And, if such a person, wearing life jacket or personal flotation device with the attached described cape and float device, falls or gets into the water from a boat, dock, or a watersports device, then the securely connected cape and float device activates simply, easily, and automatically without need of the person's assistance to deploy the cape or flag. At the conclusion of these steps, once the person with the PFD device is submerged and floating in the water, the cape and float device will lift up approximately 170 to 180 degrees vis-à-vis its original hanging position to a new position (perpendicular to the water and upright behind the rider/wearer's head) providing significant additional visibility to the floating person. The exact location is more easily known for the driver of the boat to safely return to pick them up and also, just as important, to aid other boaters with the unique visibility to see the rider/wearer, giving them extra time to react from a longer distance, to avoid accidental conflicts with the floating person.

The invention fills a need to have a device that adds significant visual awareness and therefore additional safety to people participating in many water-based activities, which often times are inherently dangerous and have many opportunities for accidents. The lack of current devices that achieve this level of additional visibility and protection when a person is floating in the open water makes this device both necessary and useful. It is additionally comfortable and easy to wear. The device automatically deploys and adds support for the head of the wearer who will float slightly backward when floating in the water, whether either conscious or, importantly, unconscious.

An important additional opportunity is the ability to get kids to want to wear the devices. This is greater now for these reasons: 1. Children, who normally do not want to wear life jackets or PFDs, can see this as a fun opportunity to wear a costume. 2. Children's products will have designs such as a super-hero cape, butterfly wings, princesses with flowing capes, angel wings, etc. 3. Parents will pay more for a safety device that children will actually want to wear, that will help keep their children safer around the water. They will gain confidence with the awareness of where their children are at a glance, even when playing in a pool.

Other aspects of the invention, including variations in apparatus, materials, and methods of use, will become more apparent upon reading the following detailed description of the exemplary embodiments.

Figures 1, 2, 3:
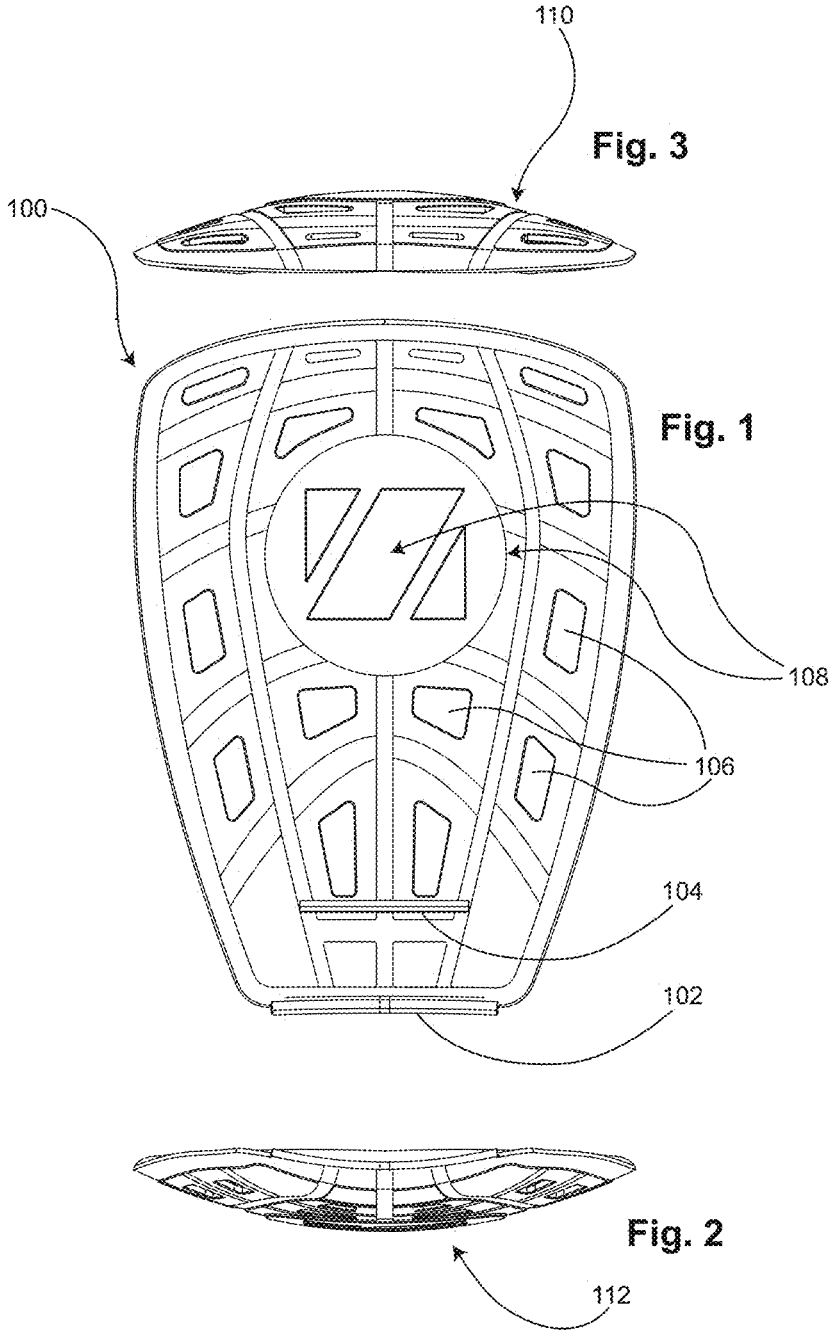
FIG. 1 shows a front view of a Visual Awareness Safety Accessory (VASA) in accord with the present invention.
FIG. 2 shows a top view of the device shown in FIG. 1.
FIG. 3 shows a bottom view of the device shown in FIG. 1.
Figures 4, 5:
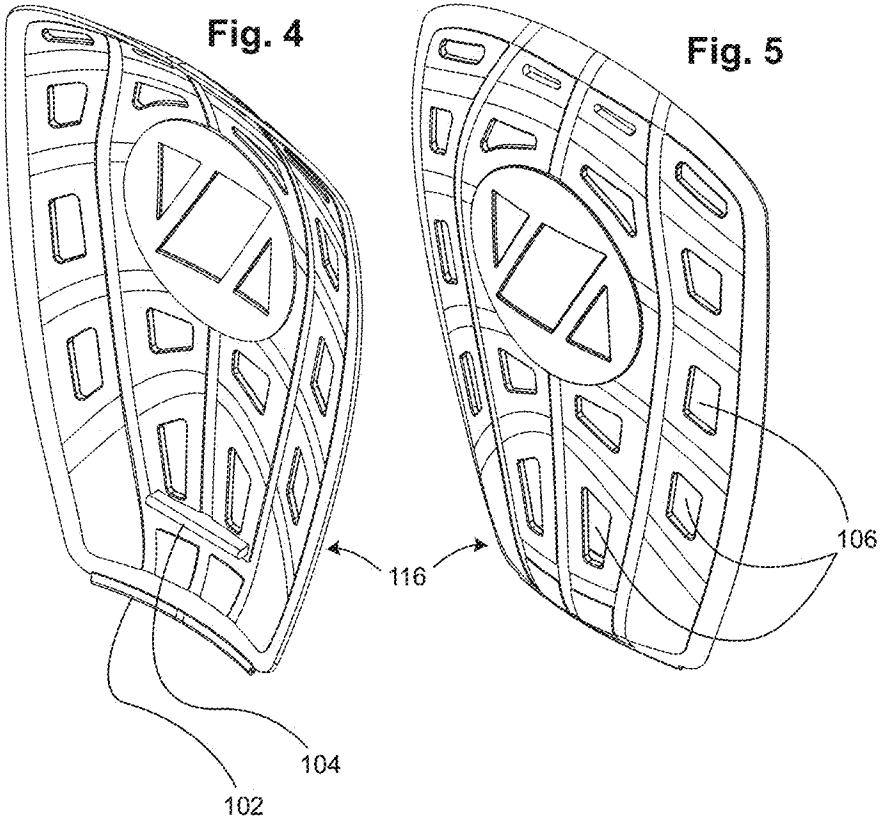
FIG. 4 shows an oblique inside view of the device in FIG. 1.
FIG. 5 shows an oblique outside view of the device shown in FIG. 1.
Figure 7:
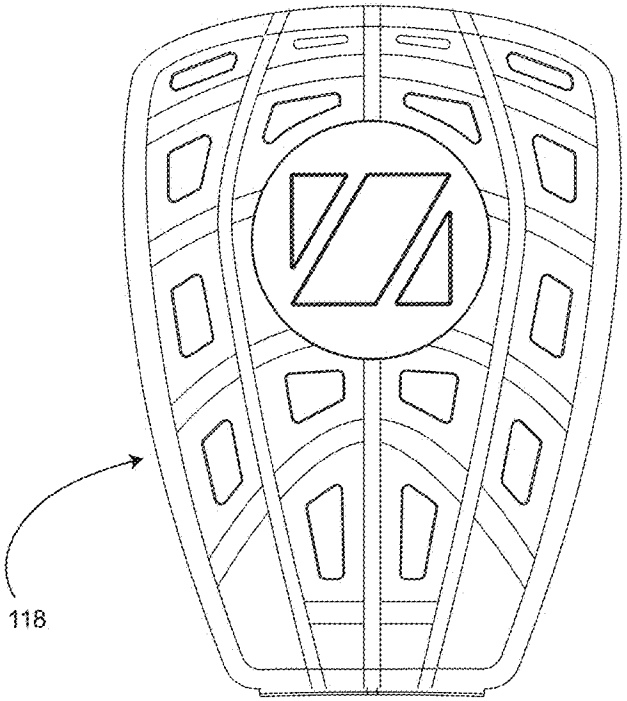
FIG. 7 shows an outside rear view of the device shown in FIG. 1.
Figure 6:
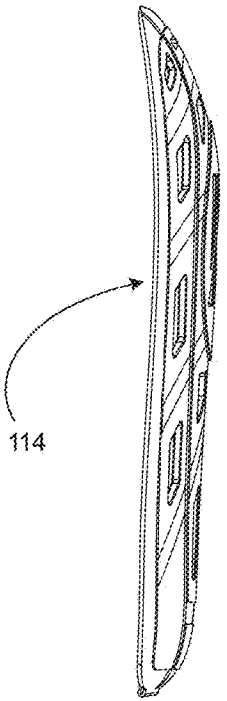
FIG. 6 shows a side view of the device shown in FIG. 1.
Figure 10:
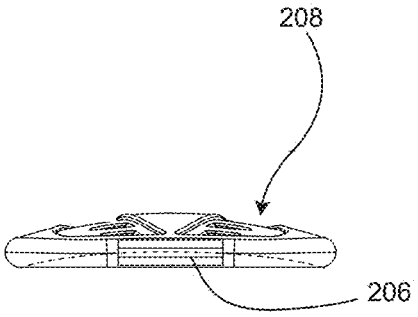
FIG. 10 shows a bottom view of the device shown in FIG. 8.
Figure 8:
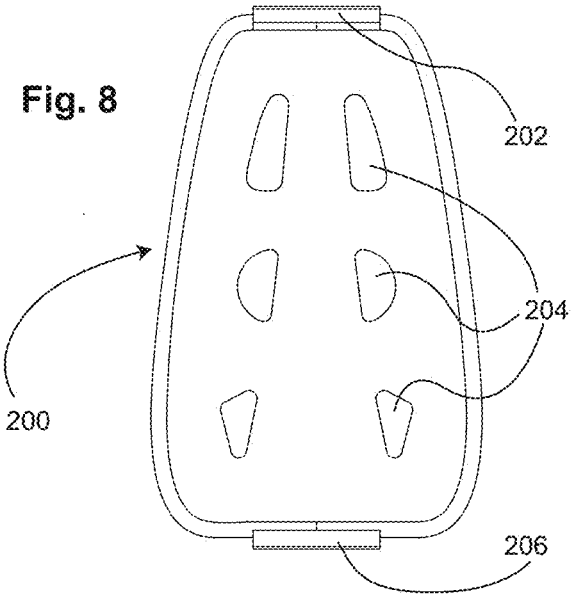
FIG. 8 shows a front view of a float associated with the device of FIG. 1.
Figure 9:
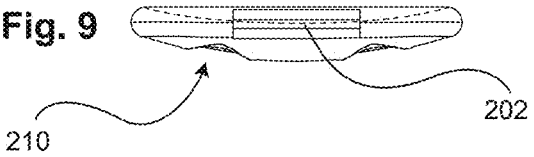
FIG. 9 shows a top view of the float of FIG. 8.
Figures 11, 12:
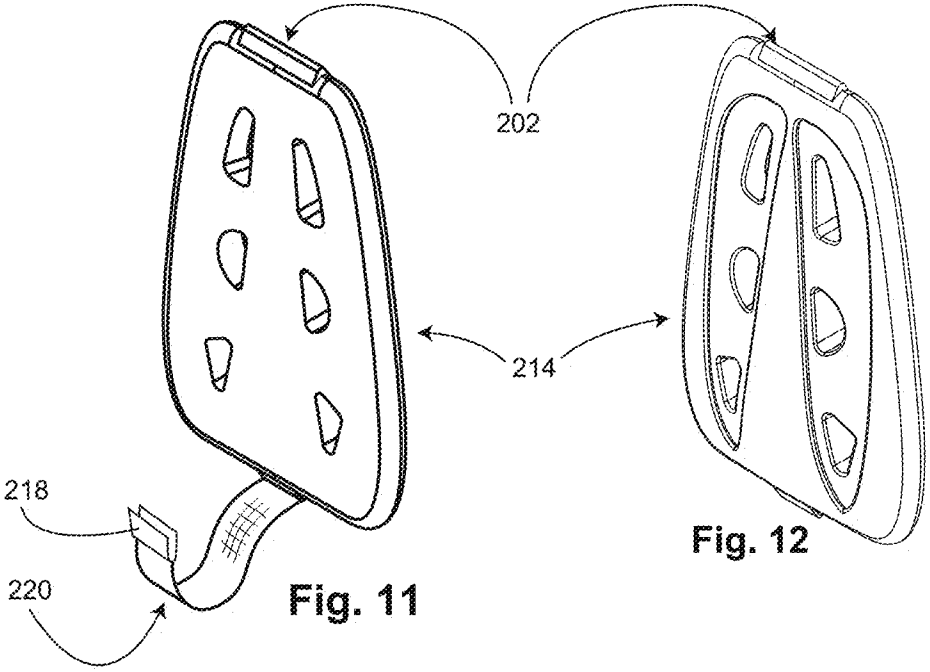
FIG. 11 shows an oblique inside view of the device in FIG. 8.
FIG. 12 shows an oblique outside view of the device shown in FIG. 8.
Figures 13, 14, 15:
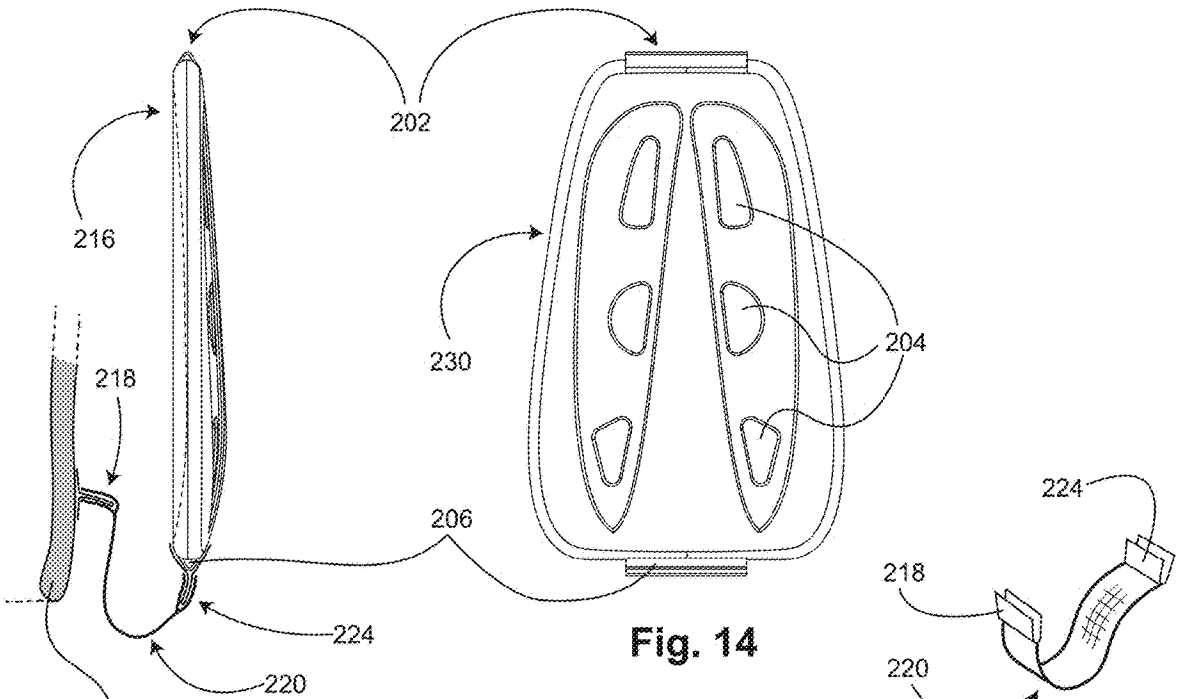
FIG. 13 shows a side view of the device shown in FIG. 8.
FIG. 14 shows an outside rear view of the device shown in FIG. 8.
FIG. 15 shows a connecting strap for use with the devices shown in FIGS. 1 and 8.
Figure 17:
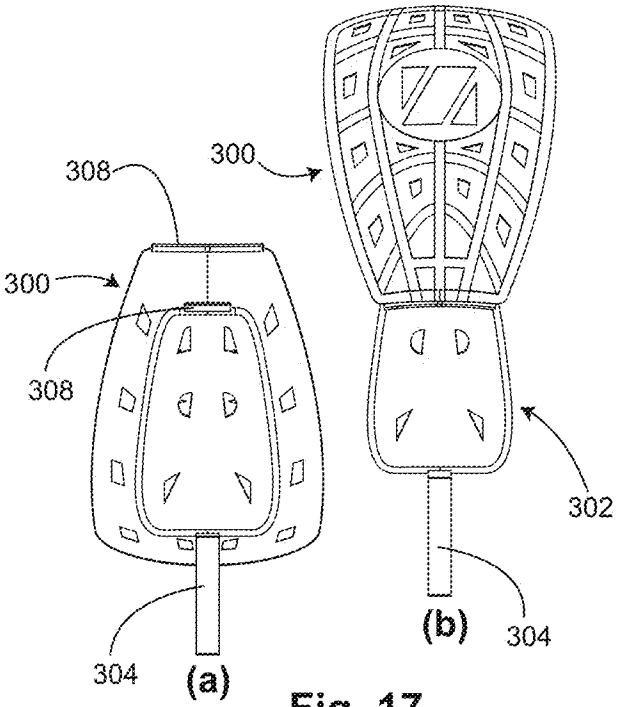
FIGS. 17(*a*) and (*b*) show an inside view of the VASA in a down and up position respectively from the front.
Figure 16:
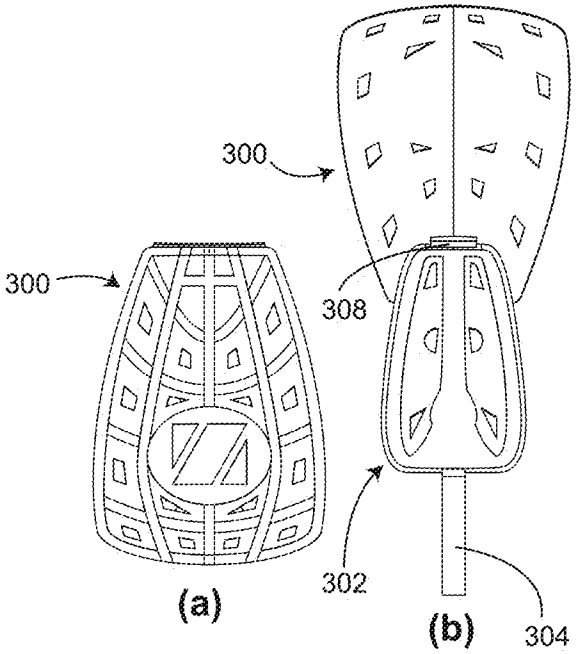
FIGS. 16(*a*) and (*b*) show an outside view of the VASA in a down and up position respectively from the rear.
Figure 19:
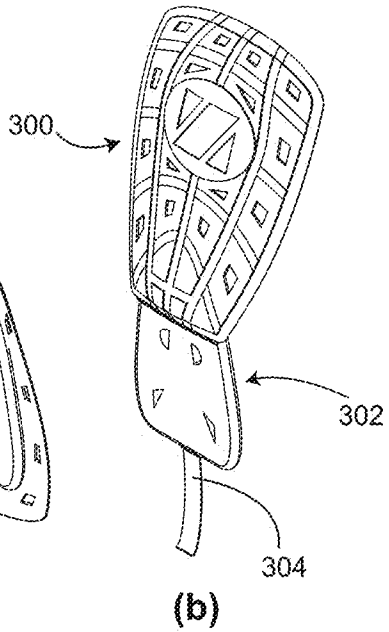
FIGS. 19(*a*) and (*b*) show an inside view of the VASA in a down and up position respectively from the front oblique view.
Figure 18:
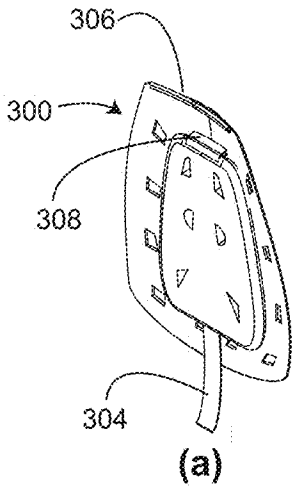
FIGS. 18(*a*) and (*b*) show an outside view of the VASA in a down and up position respectively from the rear oblique view.
Figure 18:
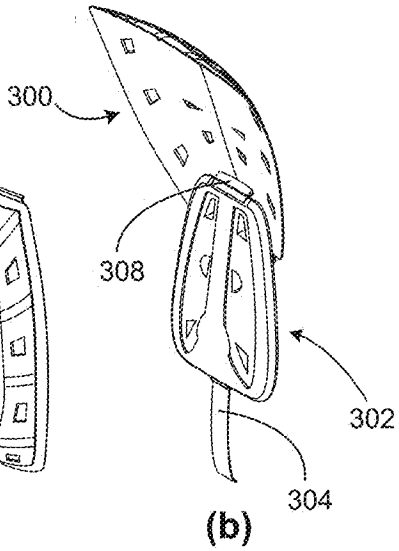
Figure 18:
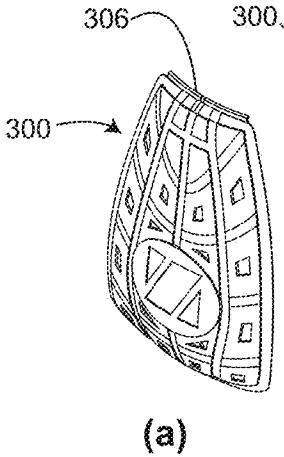
Figure 20:
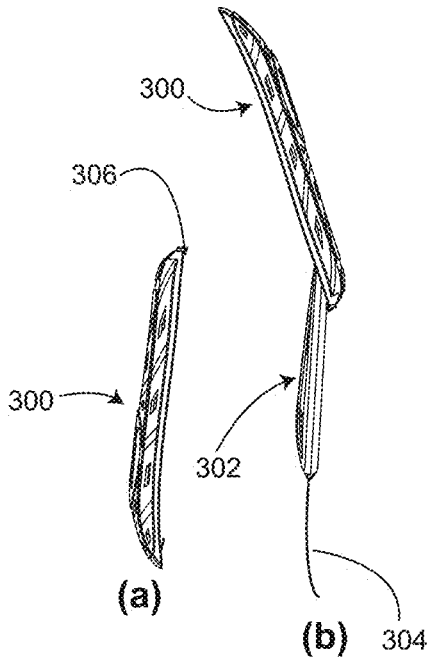
FIGS. 20(*a*) and (*b*) show an outside view of the VASA in a down and up position respectively from the side.
Figure 22:
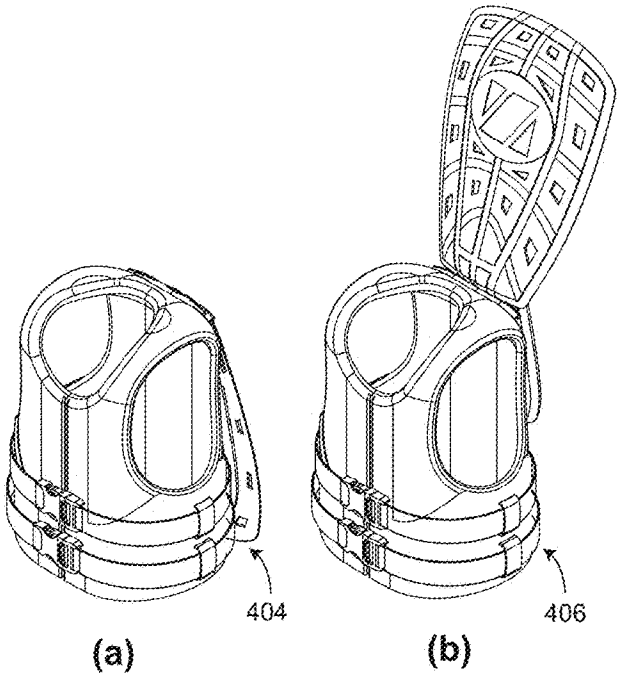
FIGS. 22(*a*) and (*b*) show an inside view of the VASA and PFD in a down and up position respectively from the front oblique view.
Figure 21:
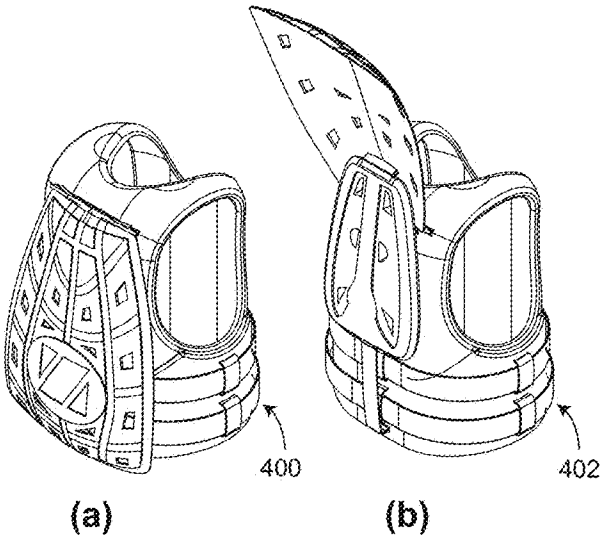
FIGS. 21(*a*) and (*b*) show an outside view of the VASA and PFD in a down and up position respectively from the rear oblique view.
Figure 25:
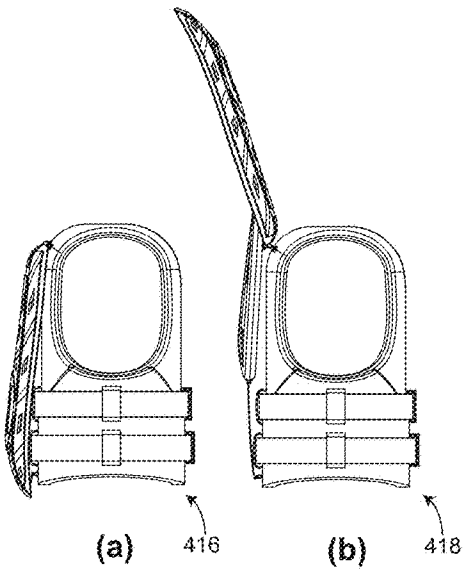
FIGS. 25(*a*) and (*b*) show an outside view of the VASA and PFD in a down and up position respectively from the side.
Figure 24:
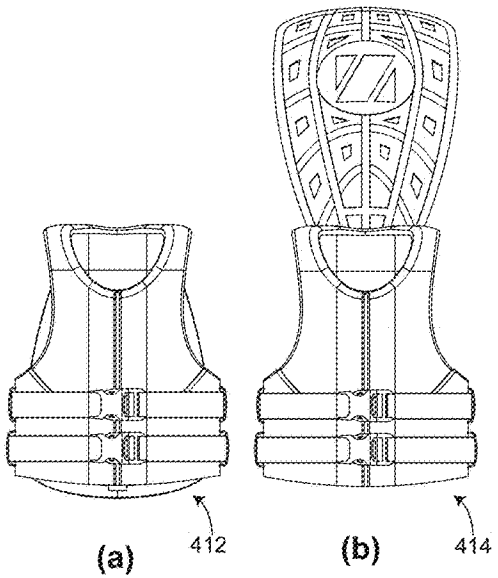
FIGS. 24(*a*) and (*b*) show a front view of the VASA and PFD in a down and up position respectively from the front.
Figure 23:
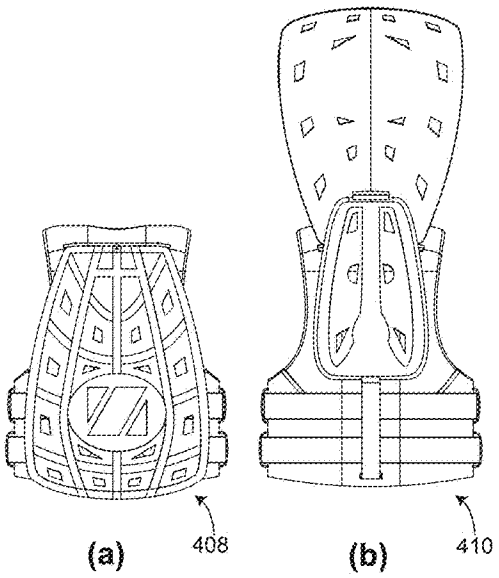
FIGS. 23(*a*) and (*b*) show an outside rear view of the VASA and PFD in a down and up position respectively from the rear.

DETAILED DESCRIPTION OF THE INVENTION:

Reference will now be made in detail to exemplary embodiments and methods of the invention as illustrated in the accompanying drawings. It should be noted, however, that the invention in its broader aspects is not limited to the specific details as set forth herein.

The core components of the VASA invention are: 1. A brightly colored waterproof cape or flag-like device; 2. A separate or combined waterproof float that lifts the colorful cape up high out of the water, once the wearer is floating in the water. This device makes the individual much more visible to those who need to spot them quickly from a much further distance away or if the waves are higher than the rider/wearer's head. These core components are attached to an existing PFD by waterproof fabric or other material by sewing, Velcro or other means, which, generally speaking, are configured as follows:

A. The bright colorful cape or safety awareness flag is attached (hinged) at the top back side of the existing life jacket or PFD. B. Under the cape, a lifter float is attached (hinged) approximately 20% of the way down the length of the cape to a hinge point that creates significant leverage to automatically lift the cape out of the water with no effort required of the person who is floating in the water, whether conscious or unconscious. C. The generally flat, yet slightly curved, rectangular lifter float is connected at the bottom back of the PFD by a strap and hinge that allows the float to rise up to the necessary height to consistently push the cape up to a vertical, or almost, position behind the wearer's head; and, considerably higher above the floating person's head.

With respect to the device, it should be further noted that when the device is attached to the back of the PFD and when the person is not in the water floating, but standing or sitting in a boat or standing on a dock or shore, the cape and lifting float will naturally rest comfortably down behind the user. When the person wearing the PFD (equipped with the described novel device) is riding a watersports towable device like a wakeboard, ZUP board, water skis, surf board, kneeboard, towable tubes, etc., the cape has the ability to flow behind the wearer/rider like a super hero with a cape. The cape adds additional visibility to the wearer/rider when riding behind a boat, personal water craft (PWC) or other towing devices and helps prevent accidental conflicts. PWC drivers or riders can also wear the device to add additional visibility to the rider, or in case they fall into the water.

The additional features of this device are:

A. It can support the wearer's head, so their head can stay above the water if resting. This is especially important, if the floating person is unconscious. The natural balance of the flotation in the combined device will be designed so that the person will naturally lean slightly back when floating. The cape may be lowered some when the person's head is laying back on it, but it still provides considerably more visual awareness than with only a little of the life jacket showing.

B. It adds comfort when not in the water and in a reclining or sitting position with ergonomic and comfortable back support.

C. It would be flexible and able to take forces when hitting the water after falling with forces normally expected in watersports activities, falling off of docks, a sailing vessel, a cruise ship or for workers on oil drilling decks, etc.

D. Curvatures of the cape and float form to the body comfortably and also allow for higher visibility from all 360 degrees of view and provide necessary vertical strength to lift the cape with the lifter float at the point which it connects. It also assists the lifting of the cape when riding in a forward direction on the water, riding watersports devices.

E. Air vents or holes in the cape and lifter float can be used to allow water or air to get through the devices. This prevents air and water from getting trapped in the devices which could prevent the best deployment of the cape when one falls into the water.

The present invention may also have one or more of the following options:

A. A version of the cape where the cape is attached to the back of the person discreetly. Rather than being pre-attached to a PFD, the device can be independent and attached to the person via a simple small wearable vest or straps. This smaller and flatter version of this present cape invention and/or float is to be smaller and rolled up or stored flat and uninflated behind the person in a smaller more discreet pouch. When needed, the cape and/or lifting float will rise up with auto inflation (via $CO_2$ or by some other air inflation method), when deployed by an automatic trigger occurring at submersion or possibly by a person pulling a pull tab physically to deploy and inflate the float and cape device. For these smaller rolled up in pouch versions, one could have much higher and larger flags, since the size will not be restricted to the size of a person's back, when not used.

B. Another option is another series of easy to spot shapes other than traditional capes or flags. The visible vertically rising bright colored and easily spotted devices for safety could be shapes that include tubes, balls, flags, banners, wings, etc.

Similarly, the method associated with the present invention may also include one of the following steps:

A. Automated deployment of the cape and/or float.

B. User deployment of the cape and/or float. User inflated with a tube.

C. A version of the device that can have illumination via LED or strobe lights around and on the cape for additional visibility in fog, darkness, rain or other situations that reduce visibility of a person in the water. These can be automatic or user turned on.

D. A version of the cape that has reflective tape or fluorescent colors on both sides of the present invention in order to enhance and maximize visibility.

In its most complete form, the present invention device is made up of the following components:

A. A cape-like or flag-like device approximately the size of a person's back. It measures from the rider/wearer's neck and goes down their back to their waist or belt line (when standing on dry ground). And it is as wide as the person's shoulders. It would be best to be made in safety orange or safety yellow colors to maximize visibility. Optional reflective strips can be added to be seen at night with spotlights, or the cape can be accessorized with LED or strobe lights that automatically or can be turned on by the user, to illuminate and or strobe to allow user to be seen easier during day, night or different weather conditions. The cape will be slightly curved at the bottom with no sharp edges or points. It will have as large a shape as possible and it will be comfortable to wear when sitting down in a chair leaning back or falling in the water. This approximate size allows it to rise tall and be as safe and as visible as possible when the wearer is in the water floating. The thickness of the cape will be approximately 0.125 to 2 inches thick. The cape will be approximately 16 to 26 inches tall×10 to 20 inches wide. It will be thicker at the top where it attaches to the person's back to aid in its structural support when the float needs to push the cape up from underneath. This is so it will not allow the cape to flex too much at the connecting hinge point, where the float pushes up against the cape once the person is submerged in the water. This will allow the thinner lighter part of the cape to rise up quickly when pushed up by the float. It will generally be thinner at the bottom near the bottom or end of the cape, when not submerged in the water. The cape will be formed to be relatively flat at the top and significantly curved as it transitions down to the bottom of the cape. It will be formed like this for both structural strength as well as for adding more visibility when it is seen from a side viewing position to the wearer. So no matter what position the wearer is in, in the water, they will always have a bright colored flag above their head. The curve also assists with the form fitting advantage of the cape to the person's back when it is lowered by a standing, sitting or resting position, when out of the water. Logos and other graphics can be added by embossing or by printing directly on the foam cape or the sewn fabric cover. These will be used to enhance the visibility of the cape above a person's head. The cape can be made of Injection Molded EVA Foam or other closed cell foam material that will hold its shape well and not get destroyed easily. This is significantly more durable foam, so it can take maximum flex when someone falls into the water at high speeds. The durometer of the EVA Foam will be soft enough to be flexible, but dense enough to not flex where the hinged foam float pushes against it. Also note that the cape may be designed with air vents or holes strategically sized and placed, so as to allow air and water to flow through the device as needed to prevent undesirable movement of the device when standing above the water, working on a boat or sailing vessel. This will prevent high winds from causing the cape to lift and push the wearer in a way that is not desired.

B. A lifting float is connected underneath the cape. Its purpose is to lift the cape vertically out of the water, when the person wearing the device is floating in the water. The described float will be made of a foam or inflatable material that is lightweight, highly buoyant and durable. This can be an injection or otherwise molded EVA, EPE or EPP material or other lightweight strong soft closed cell foam, which will not absorb water, or with an air inflatable material that is highly durable and cannot puncture or lose its air inside too easily. Its shape will be generally thicker than the cape, to have more buoyancy, yet it is still curved to be comfortable enough to rest against, when sitting in a chair. It will be about 0.5 to 2 inches thick. The Float will be approximately 8 to 14 inches tall×6 to 10 inches wide. It is generally rectangular and vertical, yet has soft comfortable edges and slightly curved sides. It is generally smaller than the cape to be virtually hidden under the cape, between the PFD and the cape, when wearer is standing or sitting and not floating in the water. It will attach approximately 3 to 6 inches from the top hinge area, below where the cape attaches to the top of the person's back or on the PFD. The connectors will be sewn together. The connectors could be fabric or mesh material. The connecting system can also be double hook and loop (Velcro) to make it removable and replaceable, if desired. It also could be electronic or heat welded together. Or the devices can be connected by means of a durable zipper to provide a safe yet removable option to replace the devices as needed. At the bottom of the vertically shaped rectangle, the float will be connected to the bottom of the person's back by a piece of fabric, a narrow strap or wide piece of mesh that allows water to flow through it easily. This is so the float does not get pushed up too harshly, when the wearer falls into the water. The float will be connected in a similar fashion on both ends, as the top hinge. If with Velcro or other hook and loop connectors, then one would generally utilize the double connector hook and loop system to secure the devices together to be as strong as possible, yet semi-permanent. Or the devices can be connected by means of a durable zipper to provide a safe yet removable option to replace the devices as needed.

C. If these two components are connected to the back of a life jacket, they can be sewn or otherwise securely attached to the back of the Life Jacket in similar fashions as the cape and float, by hook and loop or by sewing directly. If these two parts are not connected to a Coast Guard or CE approved life jacket, then it could be connected similarly to a different vest-like harness device or wearable. Or the devices can be connected by means of a durable zipper to provide a safe yet removable option to replace the devices as needed for necessary replacement or other design needs.

The most complete form of performing the method associated with the present invention device includes the following steps:

A. Person wears the PFD with the attached and connected cape and float device.

B. Person falls into the water and the cape is automatically lifted up approximately 170 to 180 degrees to a vertical position, behind the wearer's head, and substantially taller than the wearer's head to gain maximized visual attention and awareness of the wearer when they are floating in the water. Note: the cape device would normally lift up to just slightly behind the head of the person wearing the device, so as to not hit the person's head, when rising quickly. It will also not have any loss of view for the wearer, since it is behind the wearer. Even though the device would be soft, it could be disruptive to the wearer, if not designed with those attributes in mind. It should further be noted that the present invention can be used by: watersports enthusiasts at lakes and rivers, cruise ship persons wearing PFDs, people on sailing boats, workers on oil drilling rigs in the ocean, people at the beach, surfers, people on docks, or people in or near a swimming pool. This device benefits virtually anyone who has the potential to get into water and who have the potential of being difficult to locate without a large banner, cape or visual awareness system above their heads.

Similarly, the method associated with the present invention may also include one or more of the following steps:

1. Wear the properly fitted invention that is preconnected to a life jacket.

2. Jumping or falling into water, and therefore automatic deployment of the cape and/or float, by means of a lifter float raising the cape.

3. Possible user deployment of the cape and/or float, if one so desires.

4. Possible auto LED or strobe lighting begins to aid with enhanced visual awareness of the wearer floating in the water.

The present invention device is superior and unique when compared with other known water activity safety devices and solutions, because the present invention provides:

A. A unique safety awareness accessory that was created to be attached to the back of a person (via a life jacket, other PFD device or to an auto inflatable vest or straps). It is designed to add significant visibility to the wearer and therefore increase safety dramatically to water sports participants and other persons who are near water and suffer the potential of being in the water without a successful way to be seen more easily. Current life jackets are not very visible when worn and the person is floating in the water.

B. A low cost, non-mechanical auto-deploying flag, banner or cape system.

C. A comfortable safety accessory that can be worn standing, riding on the water, sitting in a boat or floating or swimming in the water.

Similarly, the associated method is unique in that it:

A. Is simple to use because it operates automatically time after time with no necessary input from the user.

B. Can be approved separately as an accessory by a Coast Guard, UL or CE approval agency.

C. Will be able to be used by children, adults, handicapable persons and animals.

The present invention is unique in that it is structurally different from other known devices or solutions. More specifically, the present invention is unique due to the presence of:

A. A bright colored large cape connected to the back of the PFD by a hinge system.

B. A float connected under the cape that lifts the cape up vertically when the wearer is floating in the water.

C. A bottom connector that connects the PFD to the bottom of the float so it allows the cape to rise up to the proper height but doesn't allow the float to come completely out of the water, so it consistently holds the cape up at a position necessary to create maximum visibility. The bottom connector stays vertical and therefore the float pushes straight up with more pressure than if the float came all the way out of the water. The cape stays vertical and can be a great asset to the rider/wearer, by becoming much more visible and to increase safety in the water.

D. Extra unneeded flotation can now be removed from the back of the PFD. This is desired to provide the needed, slightly leaning back position, of any person floating in the water wearing a life jacket plus the present invention described. This may require a slight redesign of the flotation in the attached flotation life jacket or vest-like device, so there is not too much flotation on the back of the person, once the device is connected to the back of the person.

The process associated with the aforementioned invention is unique and different from known processes and solutions. More specifically, the present invention process owes its uniqueness to the fact that it:

A. Raises a highly visible safety cape automatically without influence of the person wearing it. The cape also lowers automatically with gravity, as needed, when the person gets out of the water.

B. It is comfortable to wear standing, while riding watersports, participating in boating, swimming or sitting.

C. It lifts and flows behind the rider when participating in watersports activities, which adds to the wearer's additional visibility for safety while riding on and in the water.

D. It serves as a nice head support device if the wearer is unconscious and floating in the water.

FIGS. 1-7 show a particular component of a Visual Awareness Safety Accessory (VASA) device for a PFD (Personal Flotation Device). In this particular embodiment the inside front view of the cape-like or flag device is shown 100. The outside front view of the cape-like or flag device shown 118. 102 shows the connecting hinge point of the present device to the back top of the PFD. 104 shows the connecting hinge point for the associated lifting float component. 106 shows the optional holes that allow water and air to travel through the cape freely. 108 shows the optional logo or graphic opportunities. The top and bottom views, 110 and 112, are shown as curved to form to the back of the wearer for function (adds strength and better side visibility) and comfort to the wearer. 114 shows the side view which is also preferably curved. 116 shows the oblique ¾ front and ¾ back views of the cape-like device.

This illustrated cape device can be manufactured as a compression molded EVA foam device. Other manufacturing variations of the present invention could include air-filled PVC tubes or layered EPE foam sheets inside of a nylon, neoprene or other waterproof sewn fabric shell. It could be compression molded EVA foam, laminated to printed Fabric. It could take on a different visual look but would work or perform the necessary safety functions essentially the same way.

FIGS. 8-15 show a second particular float component of this Visual Awareness Safety Accessory (VASA) for a PFD (Personal Flotation Device). In this particular embodiment the inside front view of the lifting float device is shown 200. The outside front view of the float device is shown 230. 202 shows the connecting hinge point of the device to the inside of the curved cape-like device. 206 shows the connecting hinge point for the connected strap component 220. 204 shows the optional holes that allow water and air to travel through the device freely. The top view 208 and the bottom view 210, are designed with a preferably slightly curved design (note the hidden dashed lines) to form to the back of the wearer for function (vertical strength) and comfort to the wearer. 216 shows the side view which is also preferably slightly curved on front and back side. 214 shows the ¾ front and back views of the lifting float device. 218 shows one method of connecting the strap 220 to the bottom back of the life jacket 226. In this option, the strap could be connected with a durable double-hook and loop (Velcro) connection at these hinge points 218, 224. Options of connecting this strap to the cape at 224 and to the life jacket at 218 could be with a permanent or semi-permanent connection. If it would be desirable to have a replaceable component, then a hook and loop connecting option would be preferable. The connecting strap could be connected to the lifting float at 206 and 224 by a double hook and loop hinge method, which is a very strong semi-permanent optional method of attachment. Another option is a permanently sewn waterproof strong fabric hinge option. The connecting strap 220 can made of a durable flexible waterproof fabric or mesh material that allows water or air to move past or through it easily.

This illustrated device is shown here manufactured as a compression or injection molded EVA foam device. If manufactured using another method and system like air-filled PVC tubes, or layered EPE foam inside of nylon fabric, neoprene or other waterproof fabric shells, it would take on a different look but would work or perform the necessary safety functions essentially the same way.

Figure 35:
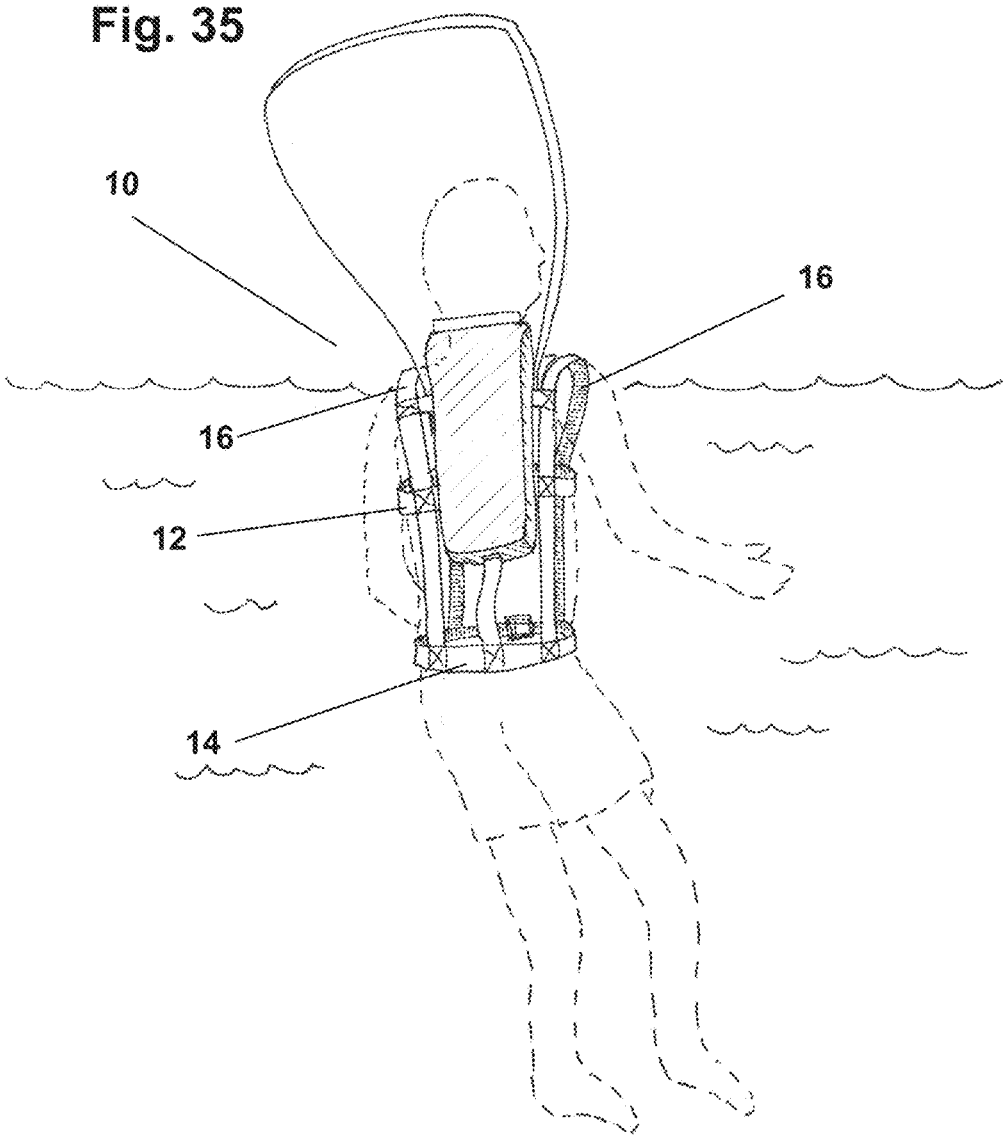
FIG. 35 is a back-view of a harness of a VASA according to the present invention.
Figure 36:
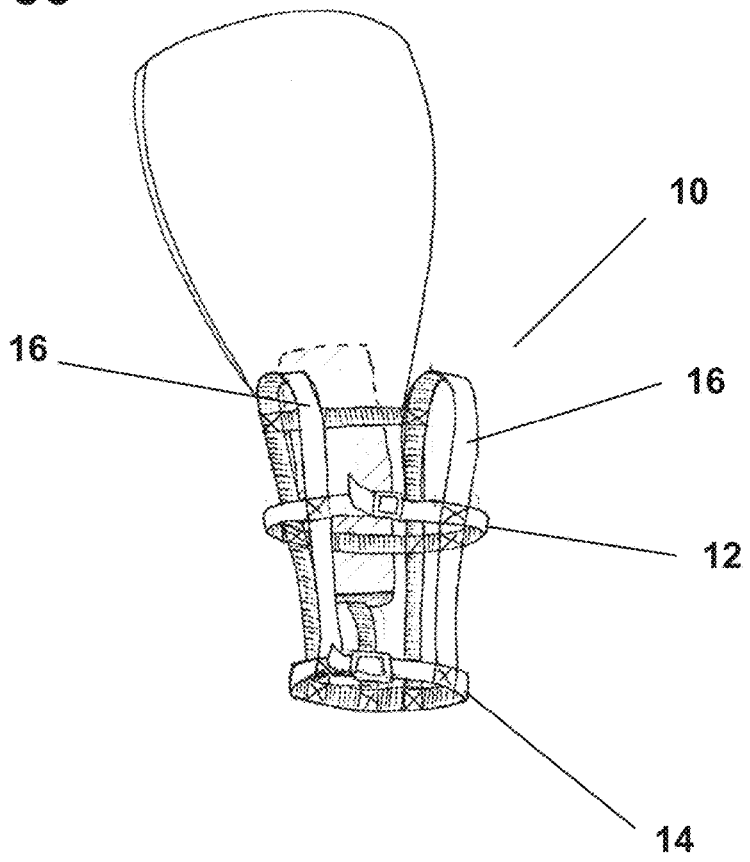
FIG. 36 is a front-view of a harness of a VASA according to the present invention.

FIGS. 35 and 36 show a harness 10 for wearing the cape and float VASA by themselves. The harness includes a strap 12 proximate the shoulder area/upper back of a wearer, and a lower waist strap 14. The upper strap is the location for the cape to hingedly connect thereto and pivot upward when immersed. The lower strap is for attachment of the float strap to hold the lower end of the float beneath the water and lift the cape into an upright position for maximum visibility. The upper and lower straps 12 and 14 form into a harness 10 using connecting shoulder segments 16 and mid and lower buckles for these respective straps. This harness enables a user to wear the VASA alone, or in combination with a PFD not already equipped with a VASA.

FIGS. 16-20 show the two devices, from FIGS. 1-15, combined (cape and float). Together they make up this Visual Awareness Safety Accessory (VASA). In this particular connected form, the Visual Awareness Safety Accessory is prepared to be easily attached to the back of a PFD (Personal Flotation Device). 300 is the cape component. 302 is the float component. 304 is the strap component. 306 is the top hinge that connects to the top back of the PFD. 308 is the hinge area on the float that attaches inside the cape.

FIGS. 21-25 show the Visual Awareness Safety Accessory (VASA) connected to the PFD (Personal Flotation Device). The PFD can be made many ways. However, the arrangement of the flotation will need to allow a person wearing the jacket to float slightly backwards when fully floating in water. This is to avoid an unconscious person unavoidably leaning forward with their head in the water.

In these FIGS. 21-25: 400 is the ¾ rear view of the combined device with the cape down. 402 is the ¾ rear view of the combined device with the cape up.404 is the front ¾ view of the combined device with the cape down. 406 is the front ¾ view of the combined device with the cape up. 408 is the rear view of the combined device with the cape down. 410 is the rear view of the combined device with the cape up. 412 is the front view of the combined device with the cape up. 414 is the front view of the combined device with the cape up. 416 is the side view of the combined device with the cape down. 418 is the side view of the combined device with the cape up.

Figure 26:
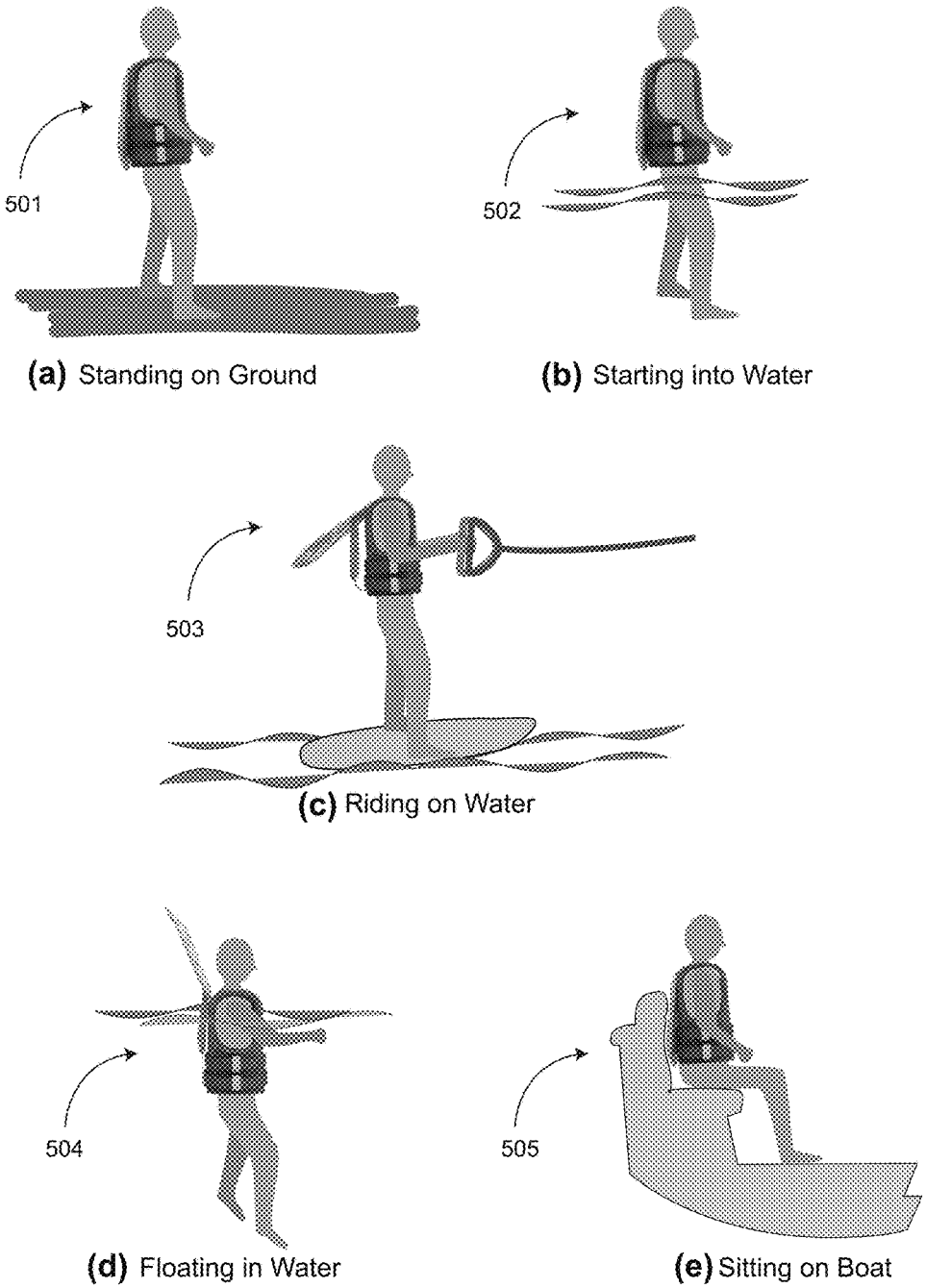
FIG. 26(*a*)-(*e*) show a user with a VASA and PFD as worn in and out of the water.

FIGS. 26(*a*)-(*e*) shows the Visual Awareness Safety Accessory (VASA) connected to the PFD (Personal Flotation Device) on a person in different positions. Each illustration shows a person from a side position. 501 shows the person wearing the present combined device walking on the ground. The device does not interfere with walking or standing. 502 shows the person wearing the present combined device walking into the water. The device does not interfere with walking or standing. 503 shows the person wearing the present combined device riding a watersports device on the water. The device does not interfere with riding watersports boards. As the cape partially lifts up, it actually adds to the person's visibility. 504 shows the person wearing the present combined device floating in the water. The device does not interfere with swimming or floating. As the cape fully lifts up, it actually adds to the person's visibility from all angles of view. 505 shows the person wearing the present combined device sitting comfortably on a seat on a boat. The device does not interfere with sitting. In fact, it is very comfortable, since it is designed to wrap around the back of the body.

The methods to print or brightly color the float and cape are as varied as the method of manufacturing. Silk screening, Pad Printing, molding or other methods of coloring the highly visible components are varied. One can attach additional reflective materials or waterproof LED lights in many ways as well.

Figure 27:
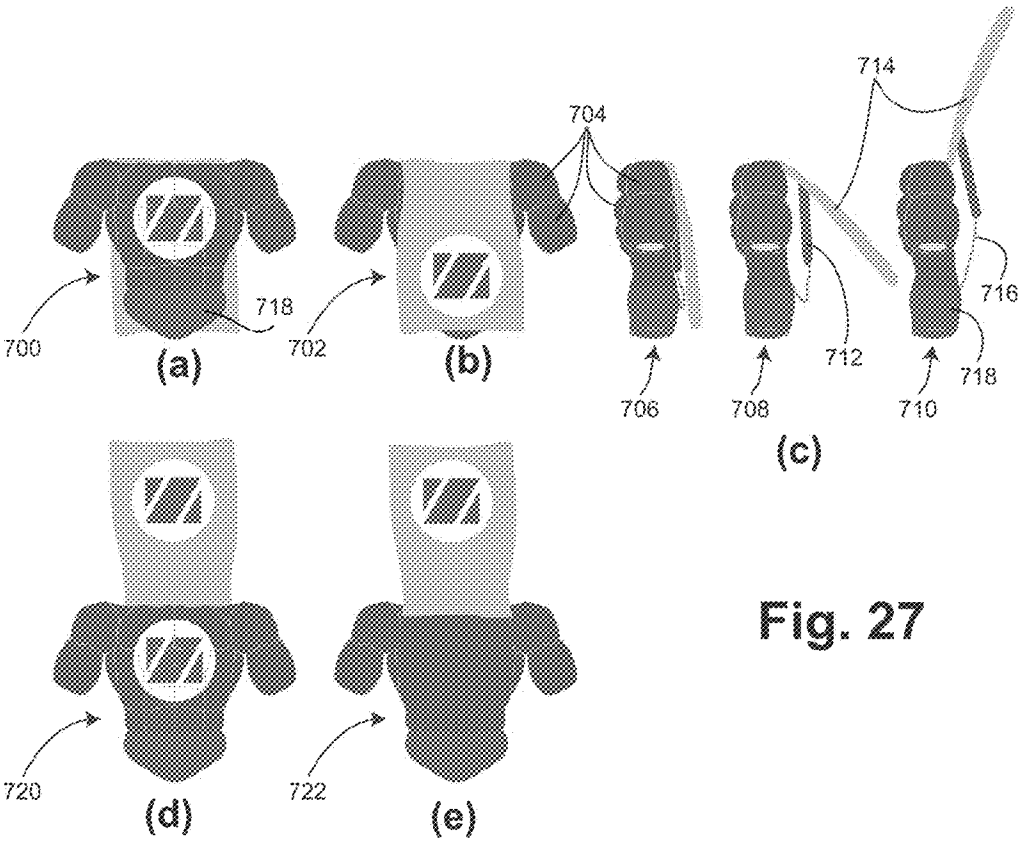
FIG. 27(*a*)-(*e*) show a children's version of a VASA and PFD in accord with the present invention.

FIGS. 27(*a*)-(*e*) and 34 show the Visual Awareness Safety Accessory (VASA) connected to a themed life jacket or PFD (Personal Flotation Device). Kid's versions of the present invention are best when the kids actually want to wear them. To this end, it would be good to have a series of PFDs that play well with the highly visible cape concept. IE: Super hero themed suits with capes and princess outfits with capes. It is best if the PFD would also be a themed costume to carry the theme through for the complete cape and float device connected to a themed PFD.

700 shows a front view of a color version of the combined device with a themed PFD combined with a themed cape 714 and lifter float 712. This is the front view. Note the muscles 704 are the flotation foam material, under the colored fabric covering. The fabric would be a printed waterproof nylon or neoprene or other stretchy fabric. 718 shows the option of having a pair of pants attached to the costume. This is so the suit would fit the child well, look and work even better. 706 shows the side view of the combined device with the float down. 708 shows the side view of the combined device with the float partially up, as the cape could appear when the child is running or riding a watersports towable. 710 shows the side view of the combined device with the float all the way up, as it would appear when the child is floating in the water. 716 shows the connecting strap fully extended. 702 shows a back view of a color version of the combined device with a themed PFD combined with a themed cape 714 and lifter float 712. 720 shows the front view with the cape up fully, as when the child is floating in the water. 720 shows the back view with the cape up fully, as when the child is floating in the water.

Figure 29:
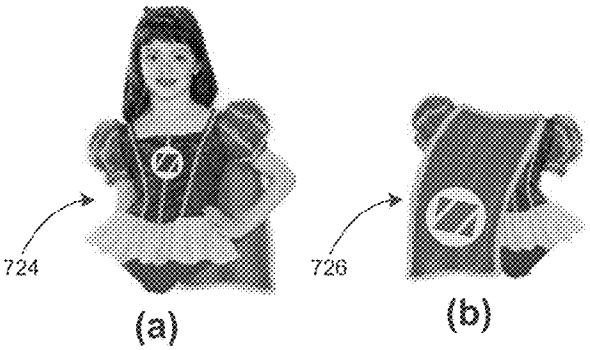
FIG. 29 shows a full costume version of the VASA and PFD in accord with the present invention.

FIGS. 29(*a*) and (*b*) and 33, show 724 a front view and 726 a back view of a princess theme option. Princesses are known to wear capes and therefore it would be thematically correct to have versions of the kid's PFD and cape combos to be princess themed. The puffy sleeves and the front breast area would be natural locations for foam flotation. As with the super hero versions, a pair of integrated pants are optional and helpful additions if desired on the princess outfits to help with the thematic look and help the safety device work even better.

Figure 28:
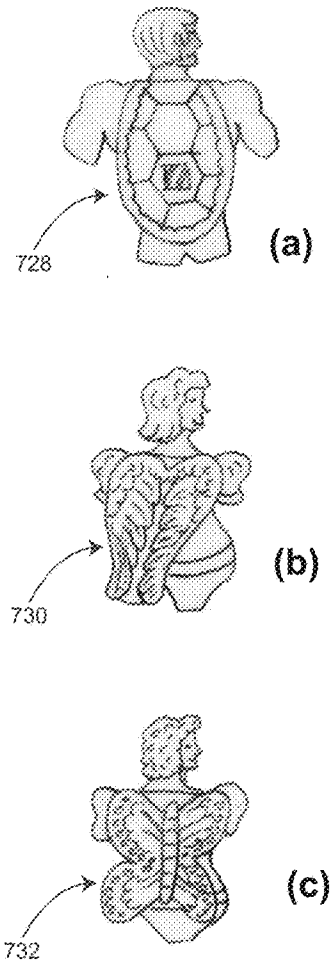
FIG. 28(*a*)-(*c*) show variations of children's version of a VASA and PFD in accord with the present invention.

FIG. 28(*a*)-(*c*) 728 shows another one of many options to theme the cape for children. It is of a turtle shell. 730 shows another one of many options to theme the cape for children. It is of a winged angel or bird. 732 shows another one of many options to theme the cape for children. It is of a butterfly or insect.

Many other options are possible. This collection of options is to show the possibilities.

Figure 30:
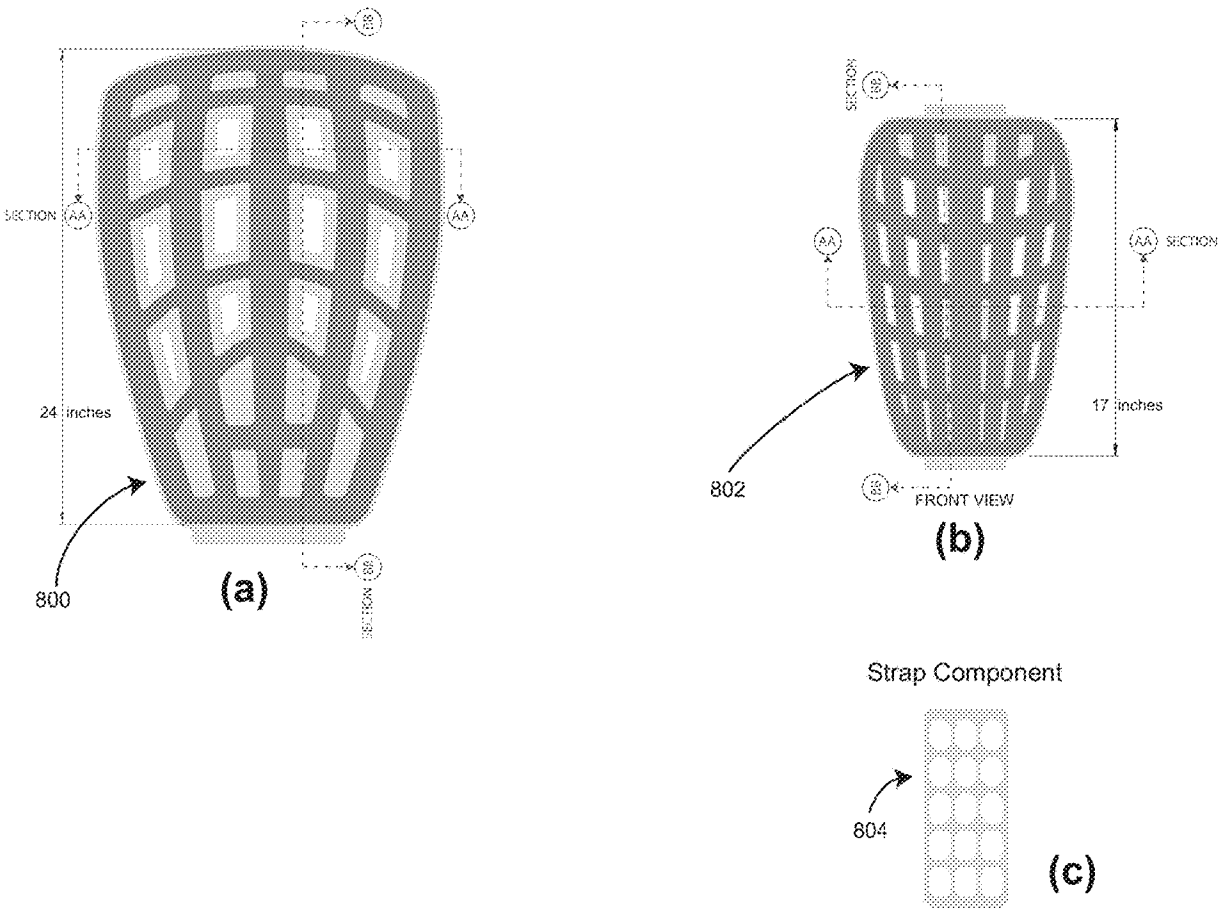
FIG. 30(*a*)-(*c*) show an inflatable version of a cape and float used in a VASA in accord with the present invention.

FIG. 30(*a*)-(*c*) shows the Visual Awareness Safety Accessory (VASA) manufactured as an inflatable air-filled device. Fabric-lined PVC is very strong and puncture resistant. 800 shows the cape component with a two color option. It also shows the die-cut holes in the cape and the connecting hinge. These allow the water and air to flow through some areas. However, it is advisable to have as much visual awareness acquired by majority of the cape to be bright colors that can be seen from a long distance. In this particular version, an orange section is to be inflated. A yellow section is not inflated. The cape could be manufactured with sonic welded seams or other permanent ways to seal the two sides of the inflatable device. The process could be sealed on a curved sealing device to allow the cape to be fully curved as is preferred in the fully inflated devise.

802 shows the lifter float component with a printed two color PVC option. It also shows the die-cut holes in the cape and the connecting hinge. These allow the water and air to flow through some areas. However it is advisable to have as much visual awareness acquired by majority of the cape to be bright colors that can be seen from a long distance. In this particular version, the orange (darker) section is to be inflated. The yellow (lighter) section is not inflated. The cape could be manufactured with sonic welded seams. The process could be sealed on a curved sealing device to allow the cape to be fully molded and curved as is preferred in this embodiment.

804 shows the yellow flat connector strap component die-cut with holes for air and water. This allows one to drop into the water and not be encumbered by resistance as you sink quickly into the water and when you start to float.

One end of this strap component would be permanently attached to the lifter float 802. The other end would be permanently connected to the PFD by sewing or other strong method. Or it could also be connected semi-permanently with the double hook and loop (Velcro) system, as on the other methods of manufacturing this safety device.

Figure 31:
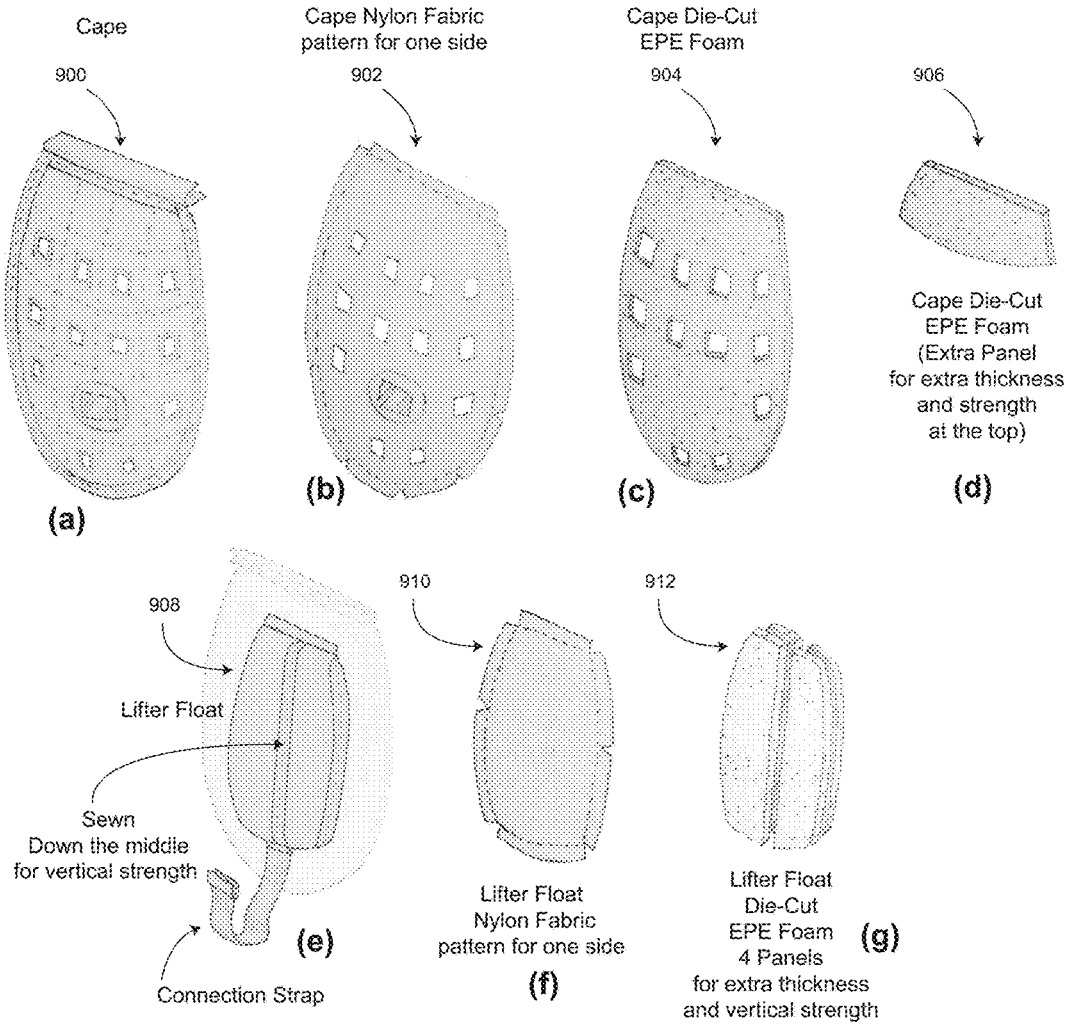
FIG. 31(*a*)-(*g*) show components of a VASA (float and cape) of a fabric and die-cut foam version of the present invention.

FIG. 31(*a*)-(*g*) show the Visual Awareness Safety Accessory (VASA) manufactured as a nylon or other strong waterproof fabric with EPE Foam inside this device, shown at 900 and 908. It also shows the manufacturing components, that would make up a simple form of this device.

902 is the outside and inside shell fabric of the cape component that would contain the closed cell EPE or other foam material, 904 and 906. Each side of the fabric shell would be sewn together in this option.

908 shows the lifter float as made by two sets of foam separated by a sewn center section to add vertical strength in this optional method of manufacturing. This is one method to also allow the lifter float to curve naturally to the wearer's back for comfort.

910 shows the outside and inside shell fabric of the cape component that would contain the closed-cell EPE or other foam material. Each side of the fabric shell would be sewn together in this option.

912 shows the die-cut foam sections that would be inside the fabric shell 910. A connection strap is permanently sewn to the bottom of the lifter float. The other end can be connected permanently or semi-permanently with a double hook and loop (Velcro) system for strength and for having the possibility of component replacement if needed.

Figure 32:
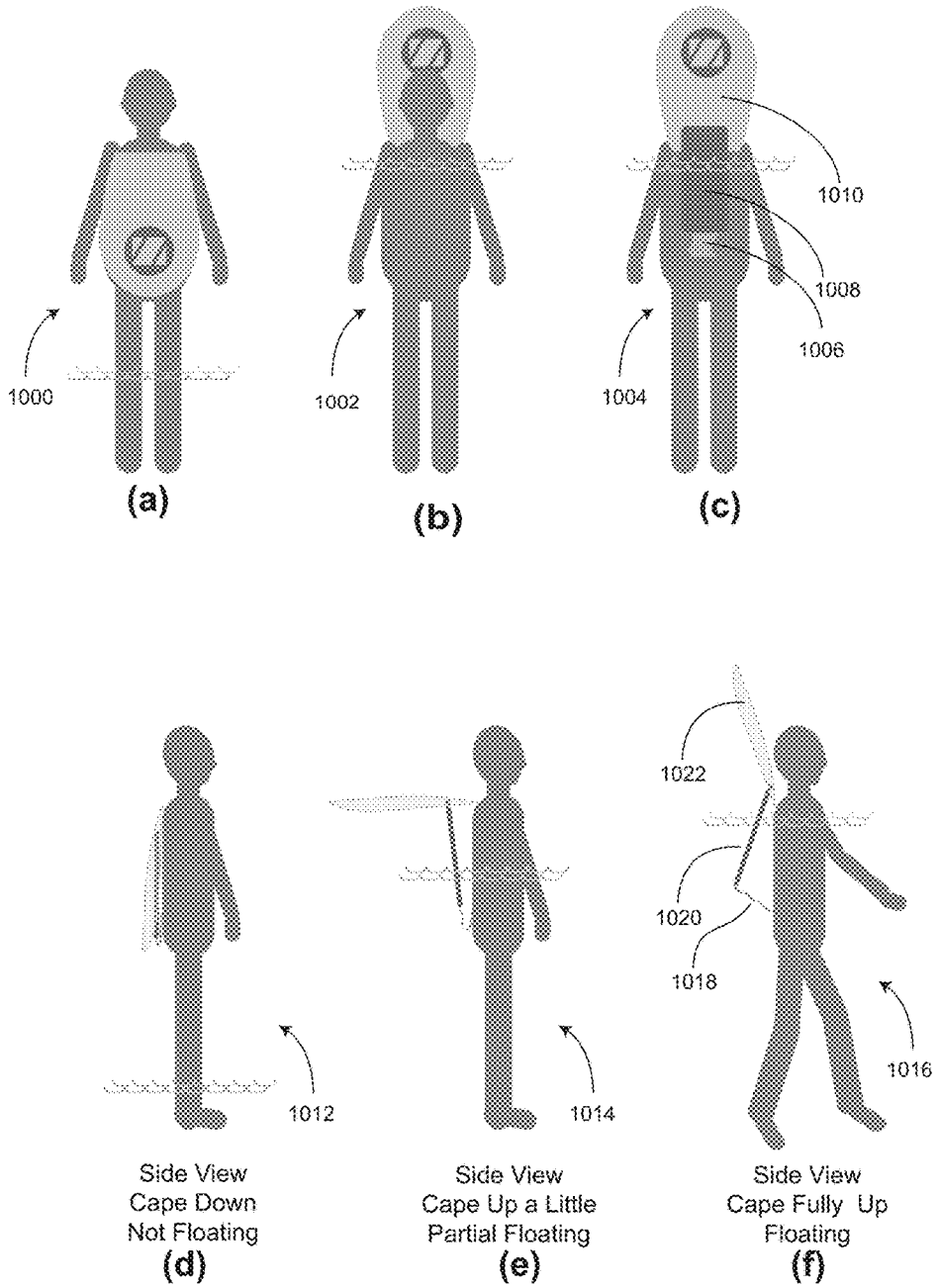
FIG. 32(*a*)-(*f*) is a pictogram of a VASA in use by a user.
Figure 33:
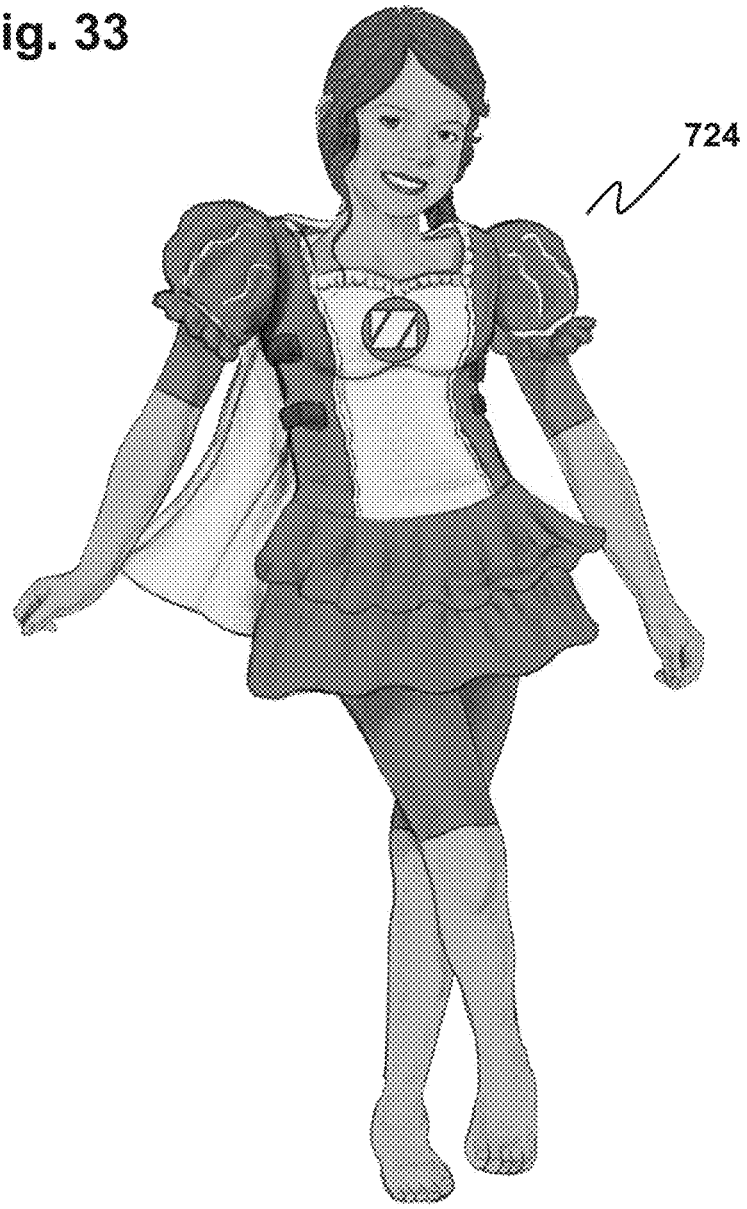
FIG. 33 is a front view of a full costume version of a VASA according to the present invention.
Figure 34:
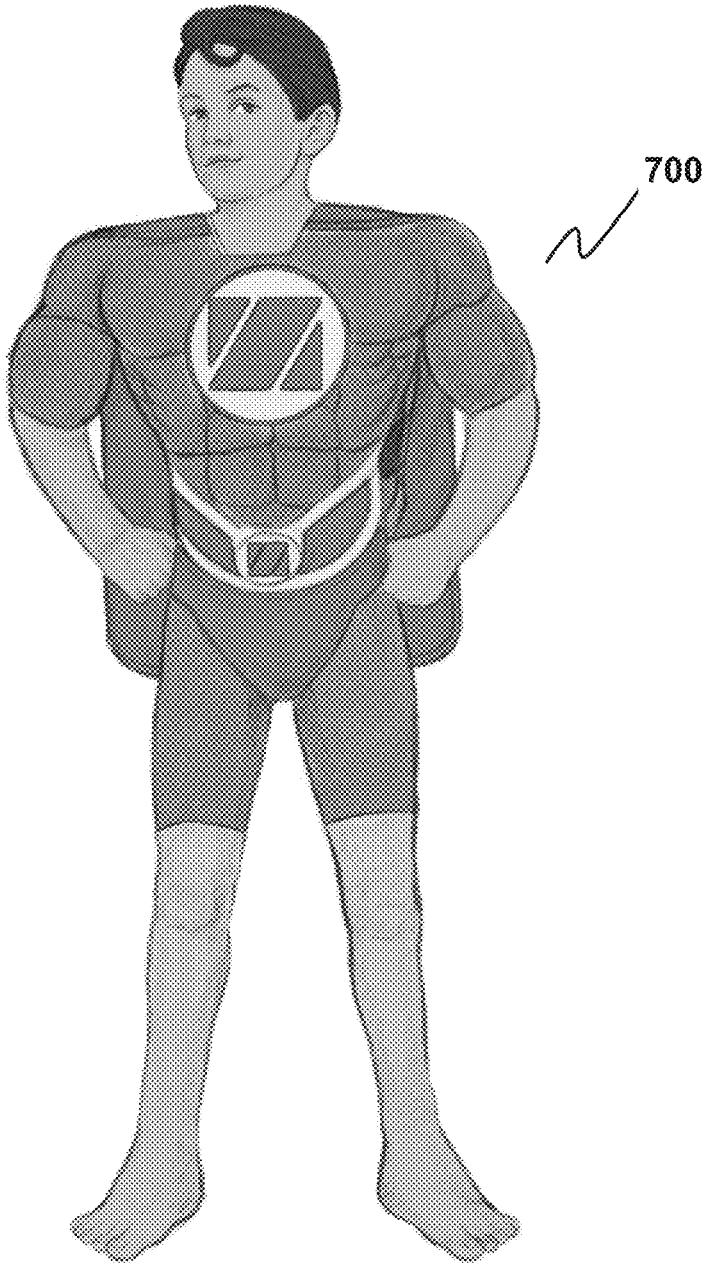
FIG. 34 is a front view of an alternate version of a costume version of a VASA according to the present invention.

FIG. 32(*a*)-(*f*) shows in pictogram form the Visual Awareness Safety Accessory (VASA) showing the cape lifting process as the device is worn successfully when going into water. 1000 shows the back of the person wearing the combined device (cape and lifter float) attached to the PFD, partially submerged in water to their knees. Note cape is down. 1002 shows the front view of the person fully floating in the water while wearing the combined device (cape and lifter float) attached to the PFD. Note the lifter float does its desired job, by lifting the cape above the wearer's head for maximum visual awareness when in the water. 1004 shows the back view of the person fully floating in the water while wearing the combined device (cape 1010 and lifter float 1008) attached to the PFD. Note the lifter float does its desired job, by lifting the cape above the wearer's head for maximum visual awareness when in the water. 1006 is the connecting strap doing its job by allowing the lifter float to push the cape up vertically to a point just inches away from the wearer's head. 1012 shows the side of the person wearing the combined device (cape and lifter float) attached to the PFD, partially submerged in water to their knees. Note cape is down. 1014 shows the front view of the person partially floating in the water while wearing the combined device (cape and lifter float) attached to the PFD. Note the lifter float does its desired job, by lifting the cape up as the water level increases. 1016 shows the side view of the person fully floating in the water while wearing the combined device (cape 1022 and lifter float 1020 and strap 1018) attached to the PFD. Note the lifter float does its desired job, by lifting the cape above the wearer's head for maximum visual awareness when person is floating in the water. 1006 is the connecting strap doing its job by allowing the lifter float to push the cape up vertically to a point just inches away from the wearer's head, but no further, to be disruptive to the wearer or by the float to come completely out of the water allowing the cape to fall back down.

Although the invention has been described in connection with several particular embodiments, it is evident that it is in no way limited to these particular embodiments and instead comprises all technical equivalents and means which fall within the scope of the appended claims.

The invention claimed is:

1. A device for enhancing visual identification of a wearer of the device, when immersed in water, comprising:

a harness including first and second strap means for engaging said wearer of said harness along a portion of their upper back and waist;

an extended flag element hingedly attached to said harness at an upper portion of said harness and draping downwardly when the device is on said wearer and is not immersed in water;

a float hingedly attached to and positioned beneath said extended flag;

a third strap means attaching a lower portion of said float, moveably, to said harness at a position nearer said wearer's waist, wherein, when said wearer is immersed in water, said float is urged upwardly with respect to said extended flag, and said flag is raised upward with respect to said hinged attachment to said harness, via said hinged attachment between said flag and float, to a position above said wearer's head.

2. A device as in claim 1, wherein:

said extended flag and float are inflatable.

3. A device as in claim 1, wherein:

said extended flag element and float are comprised of foam.

4. A device as in claim 3, wherein:

said extended flag and float are covered in a fabric layer.

5. A device for enhancing visual identification of a wearer of the device, when immersed in water, comprising:

a personal flotation device;

a harness including first and second strap means for engaging said personal flotation device along a portion of an upper back and waist of said personal flotation device;

an extended flag element hingedly attached to said harness at an upper portion of said harness and draping downwardly when the personal flotation device is on said wearer and is not immersed in water;

a float hingedly attached to and positioned beneath said extended flag;

a third strap means attaching a lower portion of said float, moveably, to said harness at a position nearer said wearer's waist, wherein, when said wearer is immersed in water, said float is urged upwardly with respect to said extended flag, and said flag is raised upward with respect to said hinged attachment to said harness, via said hinged attachment between said flag and float, to a position above said wearer's head.

6. A device as in claim 5, wherein:

said extended flag and float are inflatable.

7. A device as in claim 5, wherein:

said extended flag element and float are comprised of foam.

8. A device as in claim 7, wherein:

said extended flag and float are covered in a fabric layer.

9. A personal flotation device, comprising:

a life jacket including front and back sections and elements attaching said front and back sections one to the other;

an extended flag element hingedly attached to said life jacket at an upper back portion of said jacket and draping downwardly when the personal flotation device is on a wearer of said jacket and is not immersed in water;

a float hingedly attached to and positioned beneath said extended flag;

strap means attaching a lower portion of said float, moveably, to said life jacket at a position nearer said wearer's waist, wherein, when said wearer is immersed in water, said float is urged upwardly with respect to said extended flag, and said flag is raised upward with respect to said hinged attachment to said life jacket, via said hinged attachment between said flag and float, to a position above said wearer's head.

10. A device as in claim 9, wherein:

said extended flag and float are inflatable.

11. A device as in claim 9, wherein:

said extended flag element and float are comprised of foam.

12. A device as in claim 11, wherein:

said extended flag and float are covered in a fabric layer.

13. A device as in claim 9, wherein:

said personal flotation device forms a part of a themed costume worn by said wearer.

14. A method of for enhancing visual identification of a wearer of the device, when immersed in water, comprising:

donning a harness including first and second strap means for engaging said wearer of said harness along a portion of their upper back and waist;

said harness including an extended flag element hingedly attached to said harness at an upper portion of said harness and draping downwardly when the device is on said wearer and is not immersed in water;

a float hingedly attached to and positioned beneath said extended flag;

a third strap means attaching a lower portion of said float, moveably, to said harness at a position nearer said wearer's waist, immersing said wearer in water; wherein, when said wearer is so immersed, said float is urged upwardly with respect to said extended flag, and said flag is raised upward with respect to said hinged attachment to said harness, via said hinged attachment between said flag and float, to a position above said wearer's head.

* * * * *